United States Patent [19]

Lint et al.

[11] 4,405,164

[45] Sep. 20, 1983

[54] RATTLE-FREE DOOR LATCH

[76] Inventors: Christian L. Lint, 7800 Perimeter Rd. South, Seattle, Wash. 98108; Robert S. Lint, 1509 Logan Ave., Seattle, Wash. 98199

[21] Appl. No.: 186,452

[22] Filed: Sep. 12, 1980

[51] Int. Cl.[3] ..... E05C 1/12; E05B 3/00; E05B 15/02

[52] U.S. Cl. ..... 292/169.21; 292/350; 292/356; 292/357

[58] Field of Search ..... 292/169.21, 350, 356, 292/357

[56] References Cited

U.S. PATENT DOCUMENTS

| | | | |
|---|---|---|---|
| 629,123 | 7/1899 | Davis | 292/356 |
| 809,425 | 1/1906 | Caley | 292/356 |
| 1,058,530 | 4/1913 | Beauregard | 292/356 |
| 2,242,866 | 5/1941 | Kozlovskis | 292/350 |
| 3,179,459 | 4/1965 | Lint | 292/357 |
| 3,339,958 | 9/1967 | Lint | 292/169.21 |
| 4,067,599 | 1/1978 | Ohno | 292/356 |
| 4,223,929 | 9/1980 | Lint | 292/357 |

*Primary Examiner*—Robert L. Wolfe

*Attorney, Agent, or Firm*—Seed, Berry, Vernon & Baynham

[57] ABSTRACT

A door latch assembly in which thrust roller bearings are placed between the handles and escutcheons and axially loaded to eliminate all axial play of the handles relative to the escutcheons.

19 Claims, 18 Drawing Figures

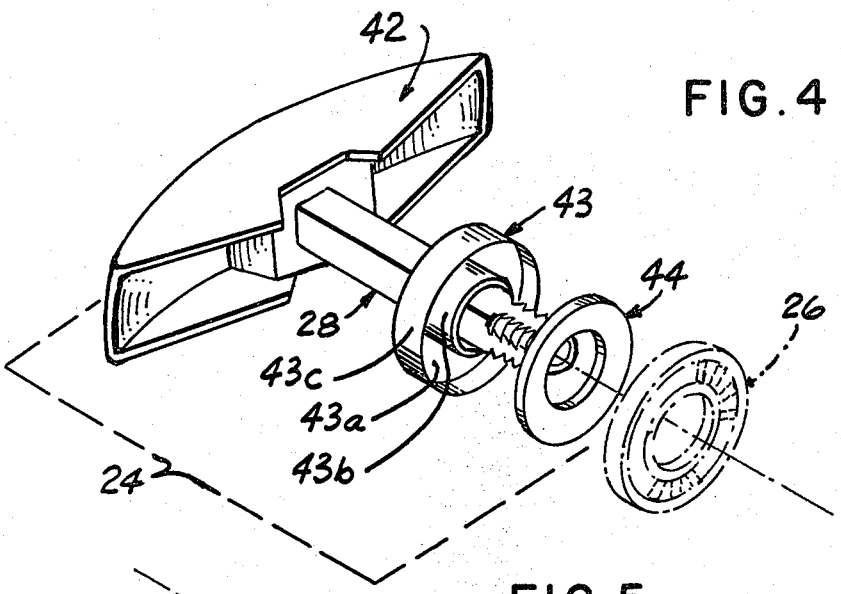
FIG. 4
FIG. 5
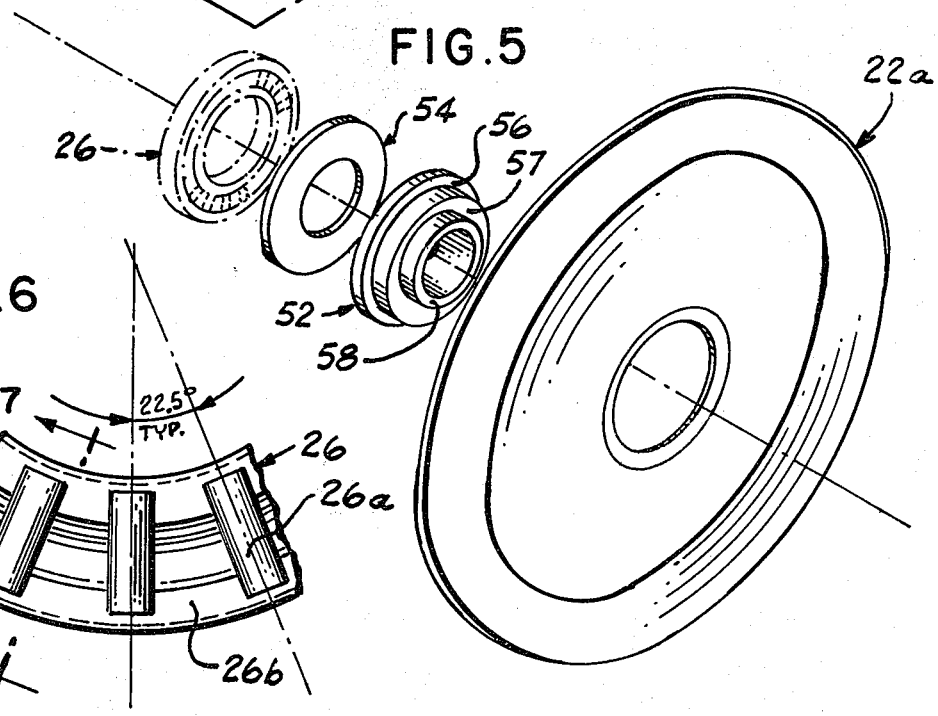
FIG. 6
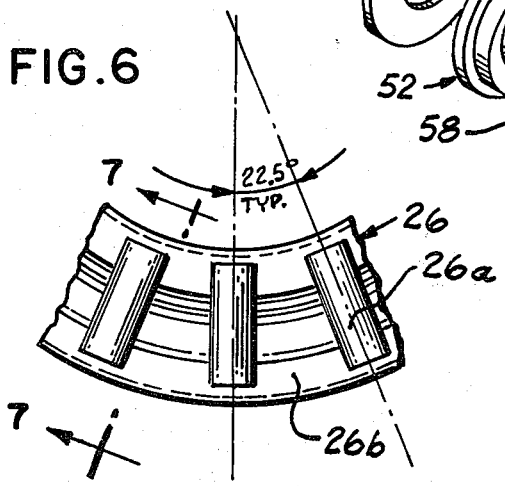
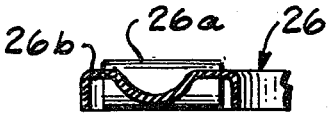
FIG. 7

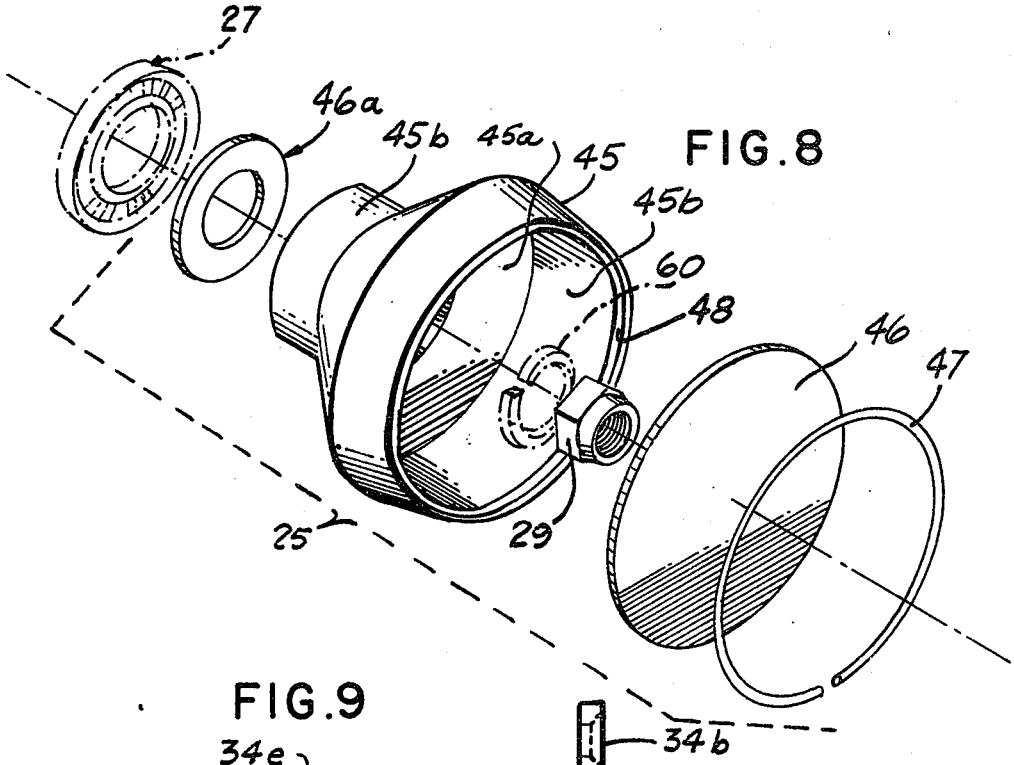
FIG.8
FIG.9
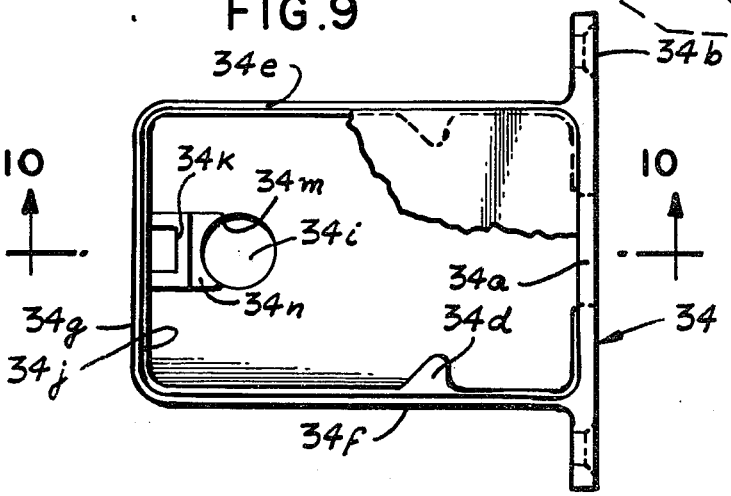
FIG.11
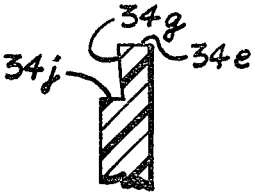
FIG.10
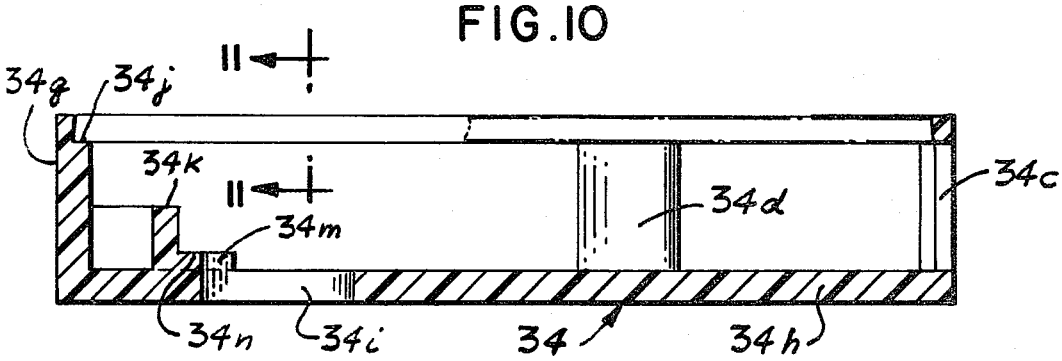

RATTLE-FREE DOOR LATCH

BACKGROUND OF THE INVENTION

1. Field of the Invention

The present invention relates to door latches of the general type in which a slide bolt is retracted by turning a handle on either side of the door in either direction in opposition to a spring and the bolt is returned by the spring to an extended position. More particularly, the invention is directed to such door latches used on inside doors in an aircraft, as, for example, a lavatory door.

2. Description of the Prior Art

Latches on lavatory doors of a commercial airliner are not only subjected to heavy use, but to constant vibration while the plane is in operation. This vibration accentuates any play in the handles or other parts of the door latch and is likely to result in annoying rattling or chattering noises, particularly if the play is between two metal parts.

A typical door latch in commercial use on airliners is shown in U.S. Pat. No. 3,339,958. In that latch, the door handles interfit with the escutcheons and are tied together by a threaded square spindle having one or two nuts which, when tightened, force the handles to move along the spindle toward the escutcheon. Nylon spacers sleeved on the spindle serve as bushings for the spindle in the escutcheons and also as partial noise dampeners respecting chatter due to the axial play in the handles relative to the escutcheons, necessary if the handles are to be free turning. The problem is that the nuts cannot be tightened to an extent making the nylon spacers thrust members, for to do so would make the handles unduly difficult, if not impossible, to turn.

There has been a long felt need for a solution to the problem of rattle or looseness of play in door latches even before the difficulty became more acute in inside doors on commercial aircraft. For example, the problem was clearly spelled out in U.S. Pat. No. 2,242,866. In that patent, special toothed clutch faces were used for fine adjustment in backing off the handles from frictional engagement with the escutcheons.

Up to the time of the present invention, fine adjustment of the handle play and use of a dampening washer or the like have been the best approaches to the latch rattling problem. But component wear and other causes in time offset the finest of adjustments.

SUMMARY OF THE INVENTION

With the foregoing in mind, the present invention aims to provide a new and superior approach for solving the latch rattling problem that results in an improved door latch that will not only be rattle-free, but simple and economical to construct, easy to assemble and install, have a long life, and normally will not require adjustment after the initial installation.

The invention further aims to provide such a latch which does not have any exposed set screws or other adjustment mechanisms, has a minimum of exposed parts, and is adapted to be used in a relatively thin door.

In accordance with this invention, thrust roller bearings are used between the handles and the escutcheons, and the handles are deliberately axially loaded such that there is not any axial play of the handles relative to the escutcheons. This axial loading is preferably maintained by axial deflection of the escutcheons or compression of a spring washer or the like.

BRIEF DESCRIPTION OF THE FIGURES OF THE DRAWING

In the accompanying drawings:

FIG. 4 is an exploded perspective view of one of the handle assemblies;

FIG. 5 is an exploded perspective view of the other escutcheon assembly;

FIG. 6 is a fragmentary plan view of a typical suitable thrust roller bearing unit;

FIG. 7 is a transverse sectional view taken on line 7—7 of FIG. 6;

FIG. 8 is a perspective exploded view of the other handle assembly and showing the nut for the spindle;

FIG. 9 is a side elevational view of the casing with part of the cover broken away;

FIG. 10 is an enlarged longitudinal sectional view taken on line 10—10 of FIG. 9;

FIG. 11 is a detail sectional view taken as indicated by line 11—11 of FIG. 10;

DETAILED DESCRIPTION OF THE PREFERRED EMBODIMENTS

Figure 21:
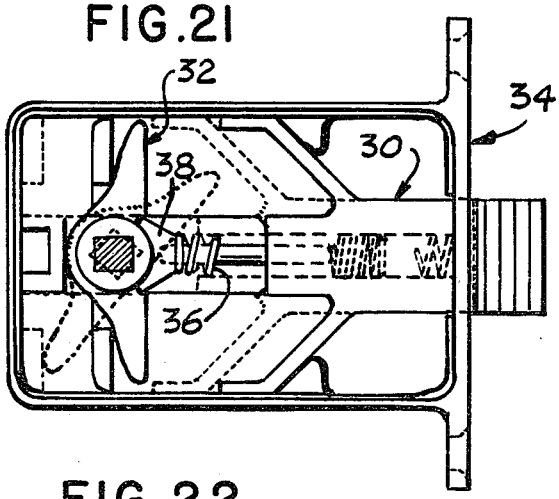
FIG. 21 is a side view with the casing cover removed of the casing, bolt, and bolt-retracting mechanism.

Referring to the drawings, the latch of the present invention has a bolt and bolt-retracting unit 20 (FIG. 21), a pair of escutcheon assemblies 22–23 (FIGS. 3,5), two handle assemblies 24–25 (FIGS. 4,8), a pair of thrust roller bearings 26–27, and a spindle 28 with tightening means which may take the form of a nut 29.

Figure 2:
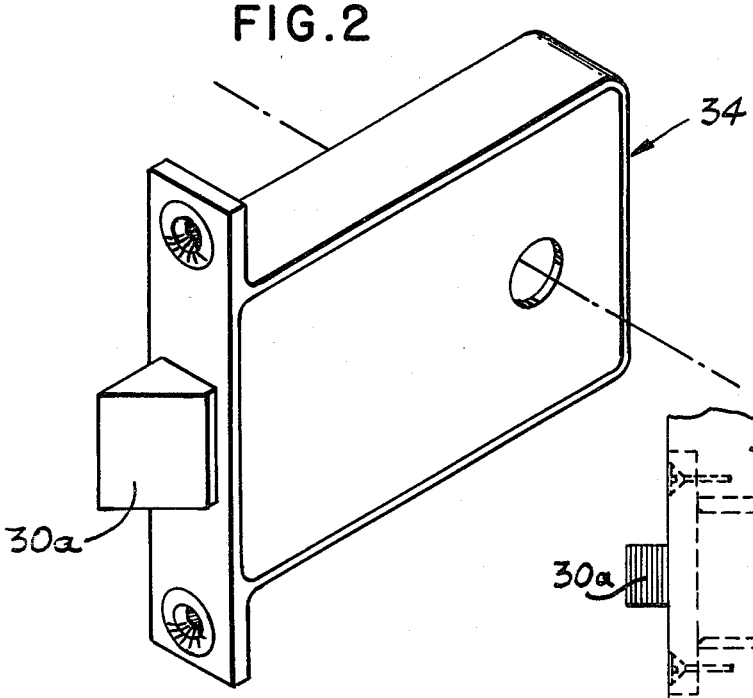
FIG. 2 is a perspective view of a casing with the slide bolt and bolt-retracting components therein.
Figure 1:
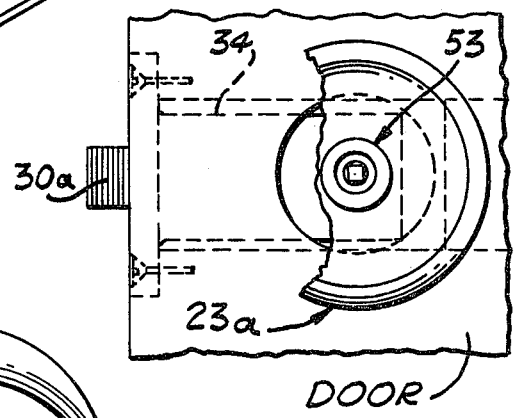
FIG. 1 is a side elevational view with parts broken away of a door with the latch of the present invention installed.

Directing attention first to the unit 20, such includes a slide bolt 30 and a retracting member 32 housed in a generally rectangular casing 34 having its front wall **34*a* extended top and bottom to provide a pair of mounting flanges 34*b* with holes 35 to receive screws for securing the casing 34 to the door frame in position within a cutout in the door in a conventional manner, as shown in FIG. 1. The front wall of the casing is formed with a rectangular opening 34*c* through which the beveled strike face 30*a* of the bolt shank 30*b* projects when the bolt is in extended position. The bolt is yieldingly urged toward its extended position by a compression spring 36 sleeved on a guide rod 37 which has its forward end portion located in a longitudinal bore 30***c* in the shank 30*b* and is formed at the rear with a fork-head 38. This head has a pair of laterally spaced forks 38*a*–38*b* fitting over the opposite end portions of a hub 32*a* on the retracting member 32.

Returning to the bolt 30, at one side it has a pair of flat fork arms 30*d*–30*e*. These arms have sloped front shoulders 30*f* joining the shank 30*b* and have rear abutments 30*g*. Forward extension of the bolt 30 is limited by engagement of the shoulders 30*e* with stops 34*d* projecting inwardly from the top and bottom walls 34*e*–34*f* of the casing 34. The abutments 30*f* are engaged by a pair of rollbacks 32*b*–32*c* radiating as cam arms upwardly and downwardly from the central portion of the hub 32*a*. The rollbacks join the hub 32*a* at a central integral collar 32*d* which is straddled at the front by the fork arms 38*a*–38*b* on the rear of the guide rod 36.

Directing attention to FIGS. 2 and 9–13, the front, back, top and bottoms walls of the casing 34, and the stops 34*d* are preferably molded as a unit from a suitable plastic with a sidewall 34*h* formed with a hole 34*i* toward the rear. The other sidewall of the casing is provided by a cover plate 40 formed with a hole 40*a* aligned with the hole 34*i*. It will be noted that the rim of the casing is stepped to the stops 34*d* to provide a recessed rim seat 34*j* for receiving the cover plate 40. Preferably, the recessed wall forming the rim seat 34*j* (see FIG. 11) and the border edge of the cover plate are beveled to provide a snap fit between the cover plate and body of the casing.

It is preferred that the casing body and cover also be formed with meeting, crush-resisting blocks 34*k* and 40*b* spaced directly behind the registering holes 34*i* and 40*a*, and that they present concave centering seats 34*m* and 40*c* inside the casing around a rear portion of the rim of such holes. These centering seats are provided by thin pads 34*n* and 40*d* formed integrally between the holes 34*i*,40*a*, and the blocks 34*k*,40*b*. The diameters of the holes 34*i*,40*a* and of the hub 32*a* of the retractor are equal, and the axial width of the hub 32*a* and the width of the slide bolt 30 are the same as the inside width of the casing 34 between the sidewall 34*h* and cover plate 40 minus a reasonable slide tolerance. Hence, when the slide bolt 30, retractor 32, spring 36 and guide rod 37 have been assembled and inserted as a unit in the casing 34 and the cover plate 40 has been applied, the center axis of the hub 32*a* of the retractor will be aligned with the center of the holes 34*i*,40*a* because of the rear seating of the end portions of the hub 32*a* on the concave seats 34*m*,40*c*.

The retractor 32 has a square axial bore 32*e* through its hub 32*a* to have a slide interfit with the spindle 28 of like cross-sectional shape. To receive the nut 29, the spindle has its corners threaded at one end.

As shown in FIG. 4, the handle assembly 24 comprises a handle 42, a bearing retainer 43 fitting in a recess in the inside of the handle, and an annular thrust washer 44 seated in the retainer 43. The retainer 43 is formed to provide a flat ring 43*a* sleeved on the spindle by an internal boss 43*b* and has an outer skirt 43*c* surrounding the boss to define therewith an annular cavity based on the ring 43*a*. This cavity houses the thrust washer 44 and the thrust roller bearing 26.

The other handle assembly 25, illustrated in FIG. 8, comprises a hollow knob 45 providing an outer cavity closed by a cover disc 46 held in place by a split keeper ring 47 seated in a groove 48 near the mouth of the cavity. Like the retainer 43, the knob 45 has an inner hub 45*a* surrounded by a skirt 45*b* to define an annular cavity for housing an annular thrust washer 46A and the other thrust roller bearing 27.

Figure 3:
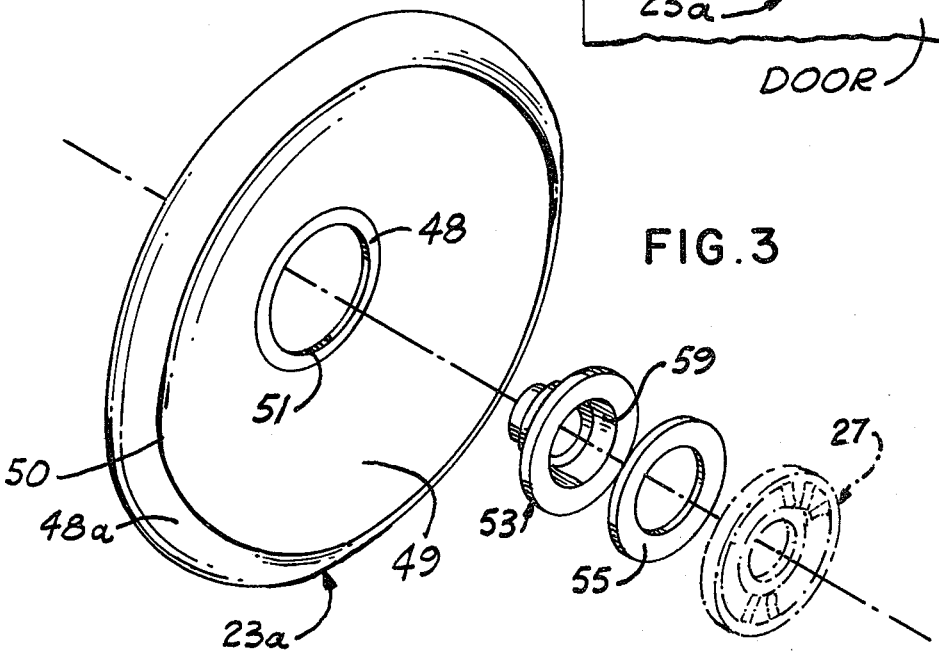
FIG. 3 is a perspective exploded view of one of the escutcheon assemblies.
Figure 12:
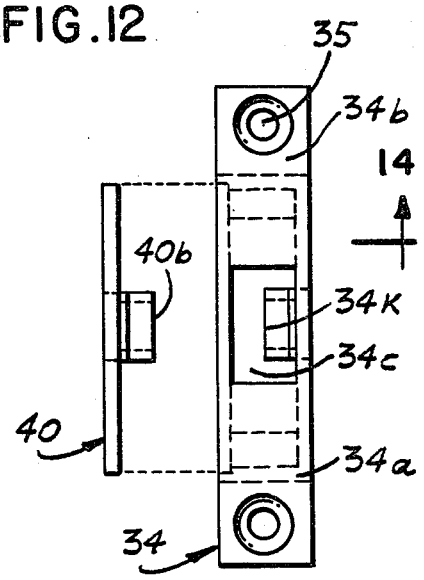
FIG. 12 is a front elevational view of the casing with the cover aligned for insertion.
Figure 13:
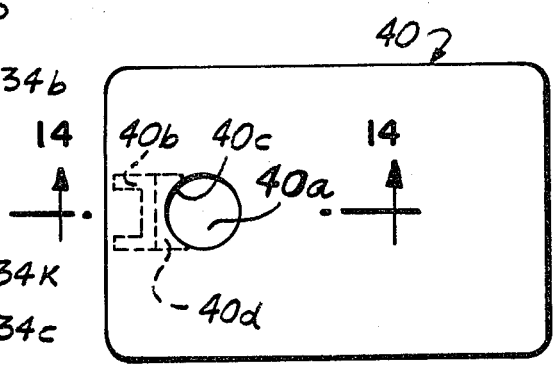
FIG. 13 is an outside plan view of the casing cover.
Figure 14:
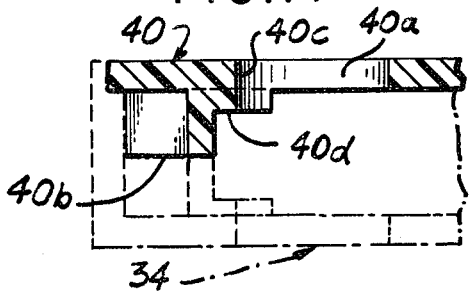
FIG. 14 is a detail longitudinal sectional view taken along line 14—14 of FIG. 13 and showing the related portions of the casing in broken lines.
Figure 16:
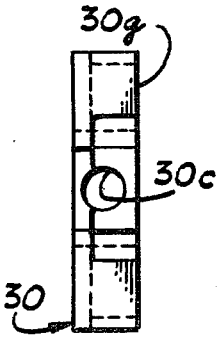
FIGS. 15, 16, 17, and 18 are plan, rear end, front end, and side views of the slide bolt, respectively.
Figure 15:
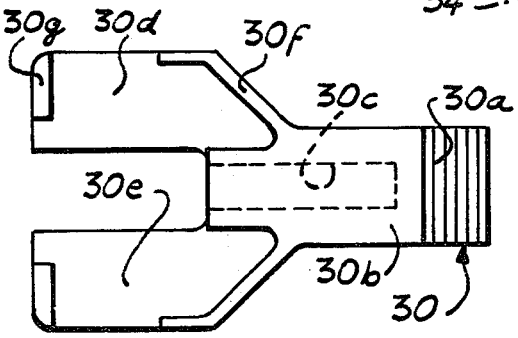
Figure 17:
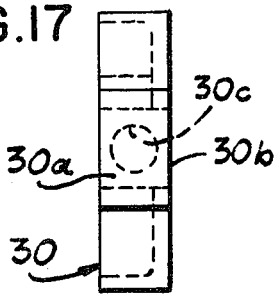
Figure 18:
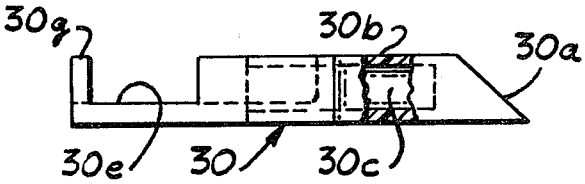
Figure 19:
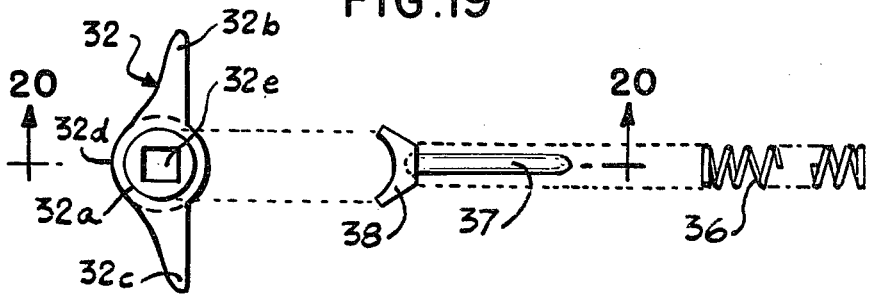
FIG. 19 is an exploded elevational view of the bolt retraction unit.
Figure 20:
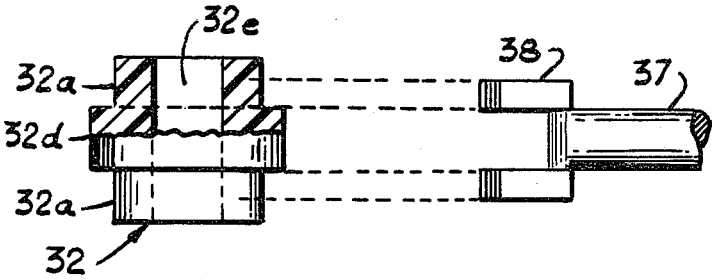
FIG. 20 is an enlarged exploded view, partly in section, as indicated by line 20—20 in FIG. 19, showing parts of the bolt-retracting mechanism.

Referring to FIGS. 3 and 5, the escutcheon assemblies 22,23 are the same and provide matching escutcheons 22*a*,23*a*. Each of these has a narrow, sloped, outer rim portion 48, a dished, relatively wide central portion 49 joining the rim portion at 50, and a narrow, flat, annular thrust portion 51 at the inside. Seated against the thrust portions 51 of the escutcheons as part of the escutcheon assemblies 22,23 are like centering members 52,53, and these assemblies also include a pair of flat thrust washers 54,55 complementing the thrust washers 44,46.

Each of the centering members 52,53 has its bore matching the diagonal dimension of the square cross-section of the spindle 28 and has two external steps. The outer 56 of these steps seats against the thrust portion 51 of the related escutcheon, and the other step 57 forms an inner boss 58 having an outer diameter corresponding to that of the casing holes 34*i*,40*a* so as to be adapted to interfit with the casing 34. At its outer, wider end, each of the centering members 52,53 is counterbored, as indicated by numeral 59, to receive the inner hub 43*b* of the retainer part 43 of the handle assembly 24 or the inner hub 45*a* of the knob 45 of the other handle assembly 25. In both instances, the hub projects axially somewhat beyond its surrounding skirt 43*c* or 45*b*. The relative axial lengths of the interfitting parts are selected so that when the thrust bearings 26,27 are snugly held between the thrust washers 44,54 and 46,55 upon tightening of the nut 29 on the spindle after all of the parts have been assembled, the skirts 43*c*,45*b* substantially hide the centering member 52, from view but do not engage the escutcheons 22*a*,23*b*, and the bosses 43*b* and 45*a* do not seat on the base of the counterbores 59 in the members 52,53.

There are a variety of inexpensive thrust roller bearings on the market suitable for use as the bearings 26–27. For example, directing attention to FIGS. 6–7 where thrust roller bearing 26 is shown, the radially extending rollers 26*a* are trapped and journaled in an annular cage 26*b* stamped from one piece of metal to a generally channel-like configuration in cross-section (FIG. 7) with the web of the channel circumferentially ribbed and formed with cutouts receiving and keeping the rollers.

Installation of the bolt 30 and bolt-retracting unit 32 in the casing 34 is easily performed. First, the retracting member 32, guide rod 37 with fork 38, and spring 36 are mounted in the bolt 30 by sleeving the spring 36 on the guide rod 37 and inserting them in the bore 30*c*, and then, after pushing the fork 38 toward the bore 30*c* to compress the spring 36 and provide adequate clearance between the fork 38 and the bolt abutments 30*g*, inserting the retracting member 32 in position with its rollbacks 32*b*,32*c* against the front of the abutments 30*g* and its hub 32*a* behind the fork 38 so that when the fork is then released, it will be urged rearwardly by the spring 36 into interfitting relation with the hub 32*a*. The resulting unit is then manipulated to pass the bolt forwardly through the front opening 34*c* and position the unit in the casing with the bolt shoulders 30*f* behind the stops 34*d* and the hub in front of the centering seat 34*c* for alignment with the hole 34*i*. Then the cover plate 40 is snapped into position. Adhesive may be applied on the meeting surfaces between the cover plate and rim of the casing before the cover plate is installed to permanently establish the casing, bolt, and bolt-retracting mechanism as a unit.

The casing 30 and housed bolt and bolt-retracting mechanism are inserted in a rectangular cutout in the door and mounted by screws on the door frame through the holes 35 in the conventional manner. This cutout is intersected by aligned round openings in the face panels of the door for receiving the central portion of the escutcheons. The handle 42, with the spindle 28 permanently attached thereto, is then assembled with the retainer 43, washer 44, and bearing 26, and the alignment member 52 is assembled with the escutcheon 22*a*. Then the escutcheon 22*a* is placed in aligned position against the door with the portion 58 fitting into the hole 40*a* of the casing cover and, after the washer 54 has been sleeved in the spindle 28, the spindle is passed through the alignment member 52, the hub 32*a* of the retracting member 32, and the casing hole 34*i* until the parts sleeved on the spindle bear against one another. Next, the other escutcheon 23*a* and alignment member 53 are assembled and placed in position on the other side of the door by sleeving the alignment member 53 on the spindle 28 and inserting the inner portion 58 of the member 53 in the casing hole 34*i*. Finally, the washer 55, bearing 27, washer 46 and handle 45 are sleeved onto the spindle and the nut 29 applied and tightened until all of the parts on the spindle on both sides of the door are firmly seated against the escutcheons 22*a*,23*a* and no play remains. Preferably, the nut 29 is further tightened to the extent that the central portions of the escutcheons are slightly deflected inwardly toward the casing 34 so as to spring-load the assembly. Such spring-loading can also be accomplished or supplemented by placing a spring washer 60 or other compression spring beneath the nut 29, as indicated in phantom in FIG. 8. It is preferred that the nut 29 be a self-locking device, as, for example, the plastic insert type, so that it will hold its tightened position.

Although the invention has been described applied to a latch assembly in which the bolt and bolt-retracting mechanism are mounted in a casing, it is to be understood that it is not intended that the invention be limited to a latch assembly of the type having such a casing. For example, a bolt and bolt-retracting mechanism of the type shown in U.S. Pat. No. 3,339,958 can be used and the boss on the rollback unit of the bolt-retracting mechanism left free of the escutcheon assembly, or extended and shaped at its extended ends to interfit with the aligning members 52,53. Since substantial axial pressure can be applied against the escutcheons by use of the present invention without binding up the handle, the escutcheons can be made to maintain the proper aligned position by their frictional engagement with the face panels of the door rather than by interfitting with the door or being dowel-connected or screw-connected to the door or a casing.

Figure 23:
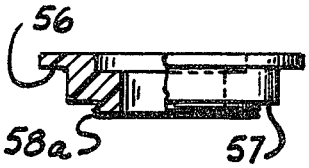
FIG. 23 is a side elevational view of a modified alignment member.
Figure 22:
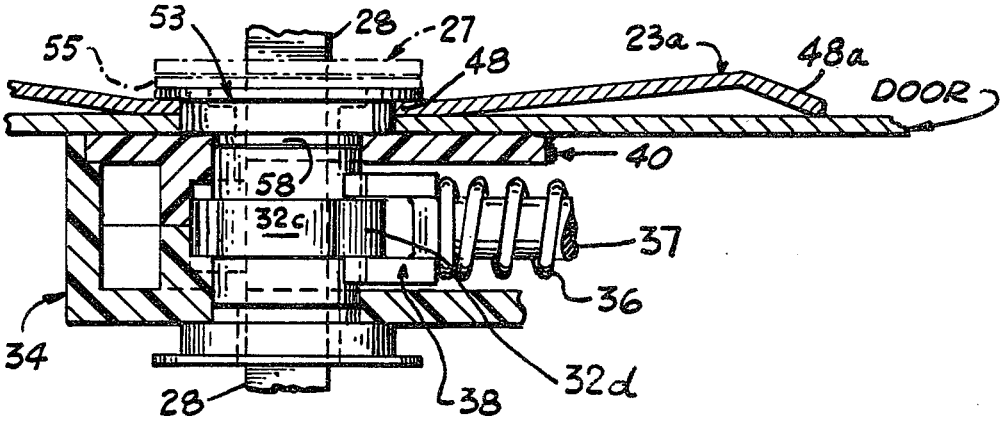
FIG. 22 is a detail longitudinal sectional view taken as indicated by line 22—22 in FIG. 24.

Also, although it is preferred when a casing is used that the escutcheon assemblies 22–23 have a sliding interfit with the casing, it is to be understood that the invention is not limited to that arrangement. For example, the escutcheon assemblies may be bolted to the casing 24, or the alignment members 52–53 may have their inner end portions 58 externally threaded, as indicated at 58*a* in FIG. 23, and screwed into threads formed along the respective annular wall of the holes 34*i*,40*a* in the casing 34 and cover 40 until the escutcheons bear against the sides of the door. In such an instance, spring-loading, as by the spring washer 60 beneath the nut 29, is still preferred.

We claim:

1. A door latch comprising:

a casing for a bolt and bolt-retracting mechanism;

a spindle passing through said casing for operating said mechanism responsive to turning of the spindle;

two escutcheon assemblies at opposite sides of said casing and having said spindle passing centrally therethrough, said escutcheon assemblies each comprising an escutcheon, a thrust washer, an outwardly facing thrust face, and an alignment member extending through the escutcheon to said casing;

two thrust roller bearings surrounding the spindle and engaging said outwardly facing thrust faces;

a first handle assembly on one end of the spindle;

a second handle assembly adjustably mounted on the other end of the spindle;

said handle assemblies presenting two respective, inwardly facing, annular thrust faces engaging respective of said bearings; and tightening means for adjusting the position of said second handle assembly along the spindle for forcing said inwardly facing thrust faces tightly against said bearings and the latter, in turn, tightly against said outwardly facing thrust faces.

2. A door latch according to claim 1 in which each said alignment member has an annular flange bearing against the outer side of the respective escutcheon.

3. A door latch according to claim 1 in which said handle assemblies each have an inwardly facing annular recess receiving a respective said thrust bearing and the related thrust washer.

4. A door latch comprising:

a casing for a bolt and bolt-retracting mechanism;

a spindle passing through said casing for operating said mechanism responsive to turning of the spindle;

two escutcheon assemblies at opposite sides of said casing and having said spindle passing centrally therethrough, said assemblies presenting two respective, outwardly facing, annular thrust faces;

two thrust roller bearings surrounding the spindle and engaging said outwardly facing thrust faces;

a first handle assembly on one end of the spindle;

a second handle assembly adjustably mounted on the other end of the spindle;

said handle assemblies presenting two respective, inwardly facing, annular thrust faces engaging respective of said bearings; and tightening means for adjusting the position of said second handle assembly along the spindle for forcing said inwardly facing thrust faces tightly against said bearings and the latter, in turn, tightly against said outwardly facing thrust faces;

the central portion of each escutcheon assembly is being adapted to be deflected to have a compression spring effect when said tightening means is tightened.

5. A door latch comprising:

a bolt and bolt-retracting mechanism;

a spindle operatively passing through said mechanism for retracting the bolt responsive to turning of the spindle;

two escutcheon assemblies at respective opposite sides of said mechanism and having said spindle passing centrally therethrough, said assemblies presenting two respective, outwardly facing, annular thrust faces;

two thrust roller bearings surrounding the spindle and engaging said outwardly facing thrust faces;

a first handle assembly on one end of the spindle;

a second handle assembly adjustably mounted on the other end of the spindle;

said handle assemblies presenting two respective, inwardly facing, annular thrust faces engaging respective of said bearings, and tightening means having a threaded interfit with said spindle and arranged to engage the outer side of said second handle assembly by forcing thrust faces tightly against said bearings and the latter, in turn, tightly against said outwardly facing thrust faces.

6. A door latch comprising:

a casing for mounting in a door;

a bolt and bolt-retracting mechanism in said casing;

a spindle passing through aligned openings in said casing for operating said mechanism responsive to turning of the spindle;

two escutcheon assemblies at respective opposite sides of said casing for engaging opposite outer sides of the door and having said spindle passing centrally therethrough, said assemblies including alignment means for aligning them with said openings and including thrust washers sleeved on the spindle and providing outwardly facing thrust faces;

two thrust roller bearings surrounding the spindle and engaging said outwardly facing thrust faces;

a first handle assembly on one end of the spindle;

a second handle assembly adjustably mounted on the other end of the spindle;

said handle assemblies presenting two respective, inwardly facing, annular thrust faces engaging respective of said bearings; and tightening means operatively associated with said spindle and second handle assembly for tightly holding said thrust bearings between said outwardly facing and inwardly facing thrust faces.

7. A door latch according to claim 6 in which said handle assemblies each have an inwardly facing annular recess housing one of said bearings and the related said thrust washer.

8. A door latch comprising:

a casing for mounting in a door;

a bolt and bolt-retracting mechanism in said casing;

a spindle passing through aligned openings in said casing for operating said mechanism responsive to turning of the spindle;

two escutcheon assemblies at respective opposite sides of said casing for engaging opposite outer sides of the door and having said spindle passing centrally therethrough;

two thrust roller bearings surrounding the spindle and engaging said outwardly facing thrust faces;

a first handle assembly on one end of the spindle adjacent one of said escutcheon assemblies;

a second handle assembly adjustably mounted on the other end of the spindle adjacent the other escutcheon assembly;

said handle assemblies presenting two respective, inwardly facing, annular thrust faces engaging respective of said bearings;

each of said escutcheon assemblies including an alignment member on the spindle and interfitting to adjacent of said handle assemblies; and tightening means operatively associated with said spindle and second handle assembly for tightly holding said thrust bearings between said outwardly facing and inwardly facing thrust faces.

9. A door latch according to claim 8 in which each said alignment member also interfits with said casing.

10. A door latch comprising:

a casing for mounting in a door;

a bolt and bolt-retracting mechanism in said casing;

a spindle passing through aligned openings in said casing for operating said mechanism responsive to turning of the spindle;

two escutcheon assemblies at respective opposite sides of said casing for engaging opposite outer sides of the door and having said spindle passing centrally therethrough;

two thrust roller bearings surrounding the spindle and engaging said outwardly facing thrust faces;

a first handle assembly on one end of the spindle adjacent one of said escutcheon assemblies;

a second handle assembly adjustably mounted on the other end of the spindle adjacent the other escutcheon assembly;

said handle assemblies presenting two respective, inwardly facing, annular thrust faces engaging respective of said bearings;

each of said escutcheon assemblies including an alignment member sleeved on the spindle, secured to said casing, and having a turning interfit with the adjacent of said handle assemblies; and tightening means operatively associated with said spindle and second handle assembly for tightly holding said thrust bearings between said outwardly facing and inwardly facing thrust faces.

11. A door latch comprising:

a casing for mounting in a door;

a bolt and bolt-retracting mechanism in said casing;

a spindle passing through aligned openings in said casing for operating said mechanism responsive to turning of the spindle;

two escutcheon assemblies at respective opposite sides of said casing for engaging opposite outer sides of the door and having said spindle passing centrally therethrough;

two thrust roller bearings surrounding the spindle and engaging said outwardly facing thrust faces;

a first handle assembly on one end of the spindle adjacent one of said escutcheon assemblies;

a second handle assembly adjustably mounted on the other end of the spindle adjacent the other escutcheon assembly;

said handle assemblies presenting two respective, inwardly facing, annular thrust faces engaging respective of said bearings;

each of said escutcheon assemblies including an alignment member sleeved on the spindle and extending partway into said casing, and said handle assemblies each having a boss extending through a respective of said thrust washers and into a respective of said alignment members; and tightening means operatively associated with said spindle and second handle assembly for tightly holding said thrust bearings between said outwardly facing and inwardly facing thrust faces.

12. In combination:

a door;

a pair of escutcheon units engaging opposite sides of the door;

a bolt and bolt-retracting mechanism in the door between the escutcheon units;

a spindle passing through said escutcheons and door for operating said mechanism responsive to turning of the spindle;

means for holding the bolt-retracting mechanism in operating position in the door and for guiding the slide bolt;

two thrust roller bearings surrounding the spindle and engaging said escutcheon units;

a first handle assembly on one end of the spindle;

a second handle assembly adjustably mounted on the other end of the spindle;

said handle assemblies engaging respective of said bearings; and tightening means for adjusting the position of said second handle assembly along the spindle for forcing said bearings tightly against said escutcheon units and the latter, in turn, tightly against the door;

said escutcheon units having respective of a pair of alignment members which are sleeved on the spindle and interfit with respective of said handle assemblies and said means for holding the bolt-retracting mechanism.

13. In a door latch assembly:

an escutcheon unit;

a spindle passing through the escutcheon unit for operating a bolt-retracting mechanism;

a handle unit on the spindle opposite the escutcheon unit and having an annular recess facing said escutcheon unit;

thrust roller bearing means surrounding the spindle and located in said annular recess; and thrust means for axially thrust-loading said handle unit against said thrust bearing means to, in turn, thrust load the latter against the escutcheon unit without axially forcing the handle unit directly against the escutcheon unit.

14. In the door latch assembly according to claim 13, said escutcheon unit being metal and having a central portion adapted to be deflected by said thrust loading to act as a compression spring.

15. In the door latch assembly according to claim 13, spring means surrounding the spindle and arranged to be loaded by said thrust means.

16. In the door latch assembly according to claim 15, said spring means comprising a portion of said escutcheon unit.

17. In a door latch assembly:

an escutcheon unit;

a spindle passing through the escutcheon unit for operating a bolt-retracting mechanism;

a handle unit on the spindle opposite the escutcheon unit;

thrust roller bearing means surrounding the spindle and located between the handle unit and the escutcheon unit; and thrust means for axially thrust-loading said handle unit against said thrust bearing means to, in turn, thrust load the latter against the escutcheon unit without axially forcing the handle unit directly against the escutcheon unit;

said escutcheon unit comprising an escutcheon and a central alignment member bearing against the handle side of said escutcheon and projecting through and beyond the escutcheon, said thrust roller bearing means exerting force against said alignment member when thrust loaded.

18. In the door latch assembly according to claim 17, said handle unit having a boss extending axially through said thrust roller bearing means into said alignment member.

19. In the door latch assembly according to claim 17, said handle unit having a skirt surrounding said thrust roller bearing means and part of the alignment member on the handle side of the escutcheon.

* * * * *